US011380226B2

(12) United States Patent
Waga et al.

(10) Patent No.: US 11,380,226 B2
(45) Date of Patent: Jul. 5, 2022

(54) METHOD OF SETTING LIGHT EMISSION CONTROL OF EACH LIGHT EMISSION TOOL IN AREA AND METHOD OF CONTROLLING LIGHT EMISSION

(71) Applicant: NEC Solution Innovators, Ltd., Tokyo (JP)

(72) Inventors: Iwao Waga, Tokyo (JP); Chikashi Ito, Tokyo (JP); Tetsuya Ito, Tokyo (JP)

(73) Assignee: NEC Solution Innovators, Ltd., Tokyo (JP)

( * ) Notice: Subject to any disclaimer, the term of this patent is extended or adjusted under 35 U.S.C. 154(b) by 585 days.

(21) Appl. No.: 16/330,446

(22) PCT Filed: Apr. 3, 2017

(86) PCT No.: PCT/JP2017/014006

§ 371 (c)(1),
(2) Date: Mar. 5, 2019

(87) PCT Pub. No.: WO2018/047391

PCT Pub. Date: Mar. 15, 2018

(65) Prior Publication Data

US 2021/0282250 A1 Sep. 9, 2021

(30) Foreign Application Priority Data

Sep. 6, 2016 (JP) ..... JP2016-173931

(51) Int. Cl.
*G09F 13/00* (2006.01)
*H05B 45/30* (2020.01)
(Continued)

(52) U.S. Cl.
CPC ..... *G09F 13/00* (2013.01); *H05B 45/30* (2020.01); *H05B 47/125* (2020.01); *H05B 47/19* (2020.01)

(58) Field of Classification Search
CPC ..... H05B 47/19
See application file for complete search history.

(56) References Cited

U.S. PATENT DOCUMENTS 7,049,483 B1 5/2006 Hudkins
7,213,940 B1 5/2007 Van De Ven et al.
(Continued)

FOREIGN PATENT DOCUMENTS

AU 2002305016 B2 5/2003
CN 1668747 A 9/2005
(Continued)

OTHER PUBLICATIONS

International Search Report for PCT Application No. PCT/JP2017/014006, dated Jun. 13, 2017.
(Continued)

*Primary Examiner* — Minh D A

(57) ABSTRACT

The present invention provides a method of setting light emission control of each light emission tool in an area more easily. The method of setting light emission control of each tool in an area of the present invention includes: a light emitting step of transmitting a freely-selected ID signal ($S_n$) to a plurality of tools in an area and emit light in response to receipt of corresponding ID signals to cause a tool ($E_n$) that has received the signal ($S_n$) to emit light; an imaging step of acquiring a light emission image ($E_n$) of the area after the signal ($S_n$) has been transmitted; a determining step of determining a position of the tool ($E_n$) that emitted light in the area based on the image ($E_n$); and a storing step of storing the position of the tool ($E_n$) in the area and the corresponding signal ($S_n$).

4 Claims, 4 Drawing Sheets

| | | | | | | | |
|---|---|---|---|---|---|---|---|
| Position 1-1 | | Position 1-2 | | Position 1-3 | | Position 1-4 | |
| ID:54 | | ID:26 | | ID:30 | | ID:22 | |
| | Position 2-1 | | Position 2-2 | | Position 2-3 | | Position 2-4 |
| | ID:90 | | ID:45 | | ID:66 | | ID:28 |
| Position 3-1 | | Position 3-2 | | Position 3-3 | | Position 3-4 | |
| ID:44 | | ID:05 | | ID:12 | | ID:33 | |

(51) Int. Cl.
*H05B 47/19* (2020.01)
*H05B 47/125* (2020.01)

(56) References Cited

U.S. PATENT DOCUMENTS

| | | | | |
|---|---|---|---|---|
| 9,198,262 | B1 * | 11/2015 | Bosua | H05B 45/60 |
| 2006/0097660 | A1 * | 5/2006 | Scott | H05B 47/155 315/291 |
| 2009/0051624 | A1 | 2/2009 | Finney et al. | |
| 2009/0122232 | A1 | 5/2009 | Seki | |
| 2010/0043104 | A1 | 2/2010 | Waga et al. | |
| 2010/0117535 | A1 | 5/2010 | Watanabe | |
| 2010/0301120 | A1 | 12/2010 | Kimura | |
| 2011/0122796 | A1 * | 5/2011 | Simons | H04W 8/186 370/254 |
| 2015/0178037 | A1 | 6/2015 | Mowry et al. | |

FOREIGN PATENT DOCUMENTS

| | | | |
|---|---|---|---|
| CN | 101435953 | A | 5/2009 |
| CN | 101514795 | A | 8/2009 |
| CN | 101923815 | A | 12/2010 |
| CN | 102305374 | A | 1/2012 |
| CN | 103123059 | A | 5/2013 |
| CN | 103236235 | A | 8/2013 |
| JP | H11-191494 | A | 7/1999 |
| JP | 2000-196556 | A | 7/2000 |
| JP | 2001-185370 | A | 7/2001 |
| JP | 2004-119212 | A | 4/2004 |
| JP | 2005-071853 | A | 3/2005 |
| JP | 2008-016291 | A | 1/2008 |
| JP | 2009-186203 | A | 8/2009 |
| JP | 2016-126968 | A | 7/2016 |
| JP | 2017-049789 | A | 3/2017 |
| TW | 201540130 | A | 10/2015 |
| WO | 2008/013202 | A1 | 1/2008 |
| WO | 2009/019764 | A1 | 2/2009 |

OTHER PUBLICATIONS

Chinese Office Action for CN Application No. 201780054286.3 dated Jun. 30, 2020 with English Translation.

Taiwanese Office Action for TW Application No. 106129238 dated Jan. 6, 2020 with English Translation.

Chinese Notice of Allowance for CN Application No. 201780054236.3 dated Jun. 2, 2021 with English Translation.

Shuping Qiu, "Searching for Green Lives", Tomorrow Press, Dec. 31, 2005, pp. 46-48.

* cited by examiner

| | | | | | | | |
|---|---|---|---|---|---|---|---|
| Position 1-1 | | Position 1-2 | | Position 1-3 | | Position 1-4 | |
| ID:54 | | ID:26 | | ID:30 | | ID:22 | |
| | Position 2-1 | | Position 2-2 | | Position 2-3 | | Position 2-4 |
| | ID:90 | | ID:45 | | ID:66 | | ID:28 |
| Position 3-1 | | Position 3-2 | | Position 3-3 | | Position 3-4 | |
| ID:44 | | ID:05 | | ID:12 | | ID:33 | |

FIG. 3

| | | | | | | | |
|---|---|---|---|---|---|---|---|
| Position 1-1 | | Position 1-2 | | Position 1-3 | | Position 1-4 | |
| ID:54 | | ID:26 | | ID:30 | | ID:22 | |
| | Position 2-1 | | Position 2-2 | | Position 2-3 | | Position 2-4 |
| | ID:90 | | ID:45 | | ID:66 | | ID:28 |
| Position 3-1 | | Position 3-2 | | Position 3-3 | | Position 3-4 | |
| ID:44 | | ID:05 | | ID:12 | | ID:33 | |

METHOD OF SETTING LIGHT EMISSION CONTROL OF EACH LIGHT EMISSION TOOL IN AREA AND METHOD OF CONTROLLING LIGHT EMISSION

This application is a National Stage Entry of PCT/JP2017/014006 filed on Apr. 3, 2017, which claims priority from Japanese Patent Application 2016-173931 filed on Sep. 6, 2016, the contents of all of which are incorporated herein by reference, in their entirety.

TECHNICAL FIELD

The present invention relates to a method of setting light emission control of each light emission tool in an area and a method of controlling light emission.

BACKGROUND ART

Electric bulletin boards in general display characters and the like by disposing light emitters (e.g., light bulbs, LEDs, and the like) in a matrix on a substrate, and causing light emitters located at positions corresponding to desired characters and the like to emit light. In such an electric bulletin board in general, since the light emitters and electrodes for causing the light emitters to emit light are disposed and fixed at predetermined positions, light emission control for displaying desired characters is easy.

SUMMARY OF INVENTION

Technical Problem

However, when electrodes for causing light emitters to emit light are not regularly but randomly disposed or the light emitters are not regularly but randomly disposed, it is very troublesome to cause the light emitters at specific positions to emit light.

Hence, the present invention is intended to provide a method of setting light emission control of each light emission tool in an area more easily.

Solution to Problem

In order to achieve the above object, the present invention provides a method of setting light emission control of each light emission tool in an area, including: a light emitting step of transmitting a freely-selected ID signal ($S_n$) to a plurality of light emission tools that are randomly disposed in an area and emit light in response to receipt of corresponding ID signals to cause a light emission tool ($E_n$) that has received the ID signal ($S_n$) to emit light; an imaging step of acquiring a light emission image ($E_n$) of the area after the ID signal ($S_n$) has been transmitted; a determining step of determining a position of the light emission tool ($E_n$) that emitted light in response to receipt of the ID signal ($S_n$) in the area based on the light emission image ($E_n$); and a storing step of storing the position of the light emission tool ($E_n$) in the area and the corresponding ID signal ($S_n$) in association with each other.

The present invention also provides a method of controlling light emission, including the step of: causing a light emission tool at a freely-selected position in an area to emit light based on information on a position of a light emission tool ($E_n$) in the area and a corresponding ID signal ($S_n$) in association with each other, wherein the method is set according to the method of setting light emission control of each light emission tool in an area according to the present invention.

Advantageous Effects of Invention

According to the present invention, it is possible to easily perform the setting of light emission control of each light emission tool in an area.

BRIEF DESCRIPTION OF DRAWINGS

FIG. 3 is a schematic diagram showing an example of an ID table in the first example embodiment of the present invention.

DESCRIPTION OF EMBODIMENTS

<Setting Method>

Figure 1:
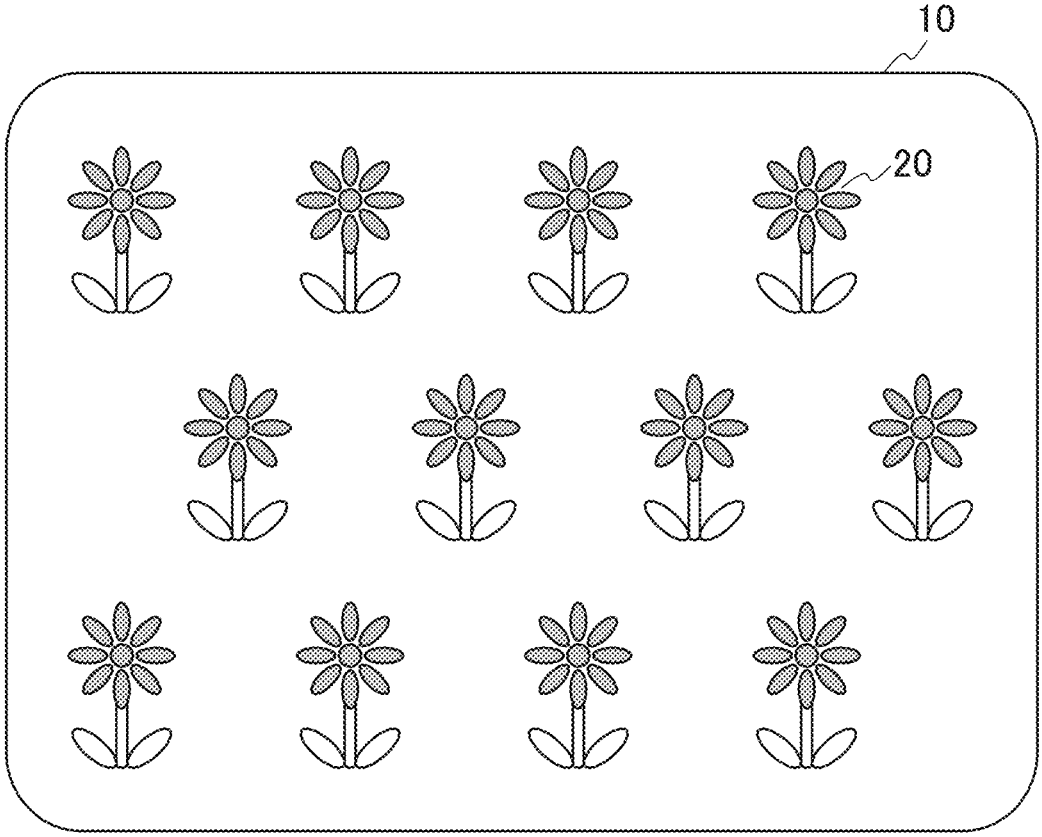
FIG. 1 is a schematic view showing an example of the setting process in the first example embodiment of the present invention.

The method of setting light emission control of each light emission tool in an area of the present invention is, as described above, characterized in that it includes: a light emitting step of transmitting a freely-selected ID signal ($S_n$) to a plurality of light emission tools that are randomly disposed in an area and emit light in response to receipt of corresponding ID signals to cause a light emission tool ($E_n$) that has received the ID signal ($S_n$) to emit light; an imaging step of acquiring a light emission image ($E_n$) of the area after the ID signal ($S_n$) has been transmitted; a determining step of determining a position of the light emission tool ($E_n$) that emitted light in response to receipt of the ID signal ($S_n$) in the area based on the light emission image ($E_n$); and a storing step of storing the position of the light emission tool ($E_n$) in the area and the corresponding ID signal ($S_n$) in association with each other.

According to the setting method of the present invention, the position of the light emission tool and the ID signal can be associated with each other by specifying the position of the light emission tool that emits light in response to a freely-selected ID signal using an image. Thus, for example, even when light emission tools are randomly disposed in the area, or even when the position of each light emission tool in the area is unknown, even when the relationship between each light emission tool and the ID signal for causing the light emission tool to emit light is unknown, it is possible to easily perform the setting of the light emission control of each light emission tool. This method can be applied to even a larger area.

In the setting method of the present invention, for example, the light emitting step, the imaging step, the determining step, and the storing step are repeatedly performed.

In the setting method of the present invention, the light emission tool may include a main body and a receiver. In this case, for example, the receiver is attached to the main body, the main body is a member that emits light by excitation light, and the receiver is a member that emits excitation light in response to a corresponding ID signal.

The receiver is, for example, a wireless light source. Specifically, the wireless light source may be, for example, a wireless LED. The LED may be, for example, an LED black light or the like.

The main body may be, for example, a plant individual that emits light by excitation light. The plant individual may be, for example, a flowering plant. The plant that emits light may be, for example, a plant that generates a fluorescent protein, and reference can be made to Japanese Unexamined Patent Application No. 2008-022817.

The main body may be, for example, a pen light or the like that emits light by excitation light.

The example embodiments of the present invention are described below with reference to the drawings. It is to be noted, however, that the present invention is by no means limited or restricted by the following example embodiments. In the following drawings, identical parts are indicated with identical reference signs. Regarding the descriptions of the example embodiments, reference can be made to one another unless otherwise stated. Furthermore, the configurations of the example embodiments can be combined unless otherwise stated.

First Example Embodiment

The first example embodiment shows an example in which the main body of the light emission tool is a plant individual that emits light by excitation light and the receiver of the light emission tool is a wireless LED.

In recent years, a plant (hereinafter, also referred to as a "glowing plant") that emits light by excitation light irradiation by introducing an expression system of a fluorescent protein has been developed and achieved. Thus, the inventors of the present invention have considered that, by planting glowing plants in a flower bed and attaching a wireless LED that emits light in response to receipt of an ID signal to each individual with a clip or the like, characters and the like can be displayed using the flower bed as a display and the plant individuals as elements. However, it is not practical to attach a wireless LED that emits light in response to a predetermined ID signal to each plant individual in the flower bed in order, for managing the position of a plant individual in the flower bed and an ID signal corresponding to a wireless LED attached to the plant individual in association with each other. In this regard, according to the present invention, even when the relationship between the position of the plant individual, which is a light emission tool, and an ID signal corresponding to each plant individual is unknown, the setting of the light emission control can be performed for the above-described reason.

An outline of the present example embodiment is described below with reference to FIGS. 1 to 4. First, as shown in FIG. 1, a wireless LED that emits light in response to an ID signal is randomly attached to each of the flowers randomly planted in the flower bed 10, thereby preparing a light emission tool 20.

Figure 2:
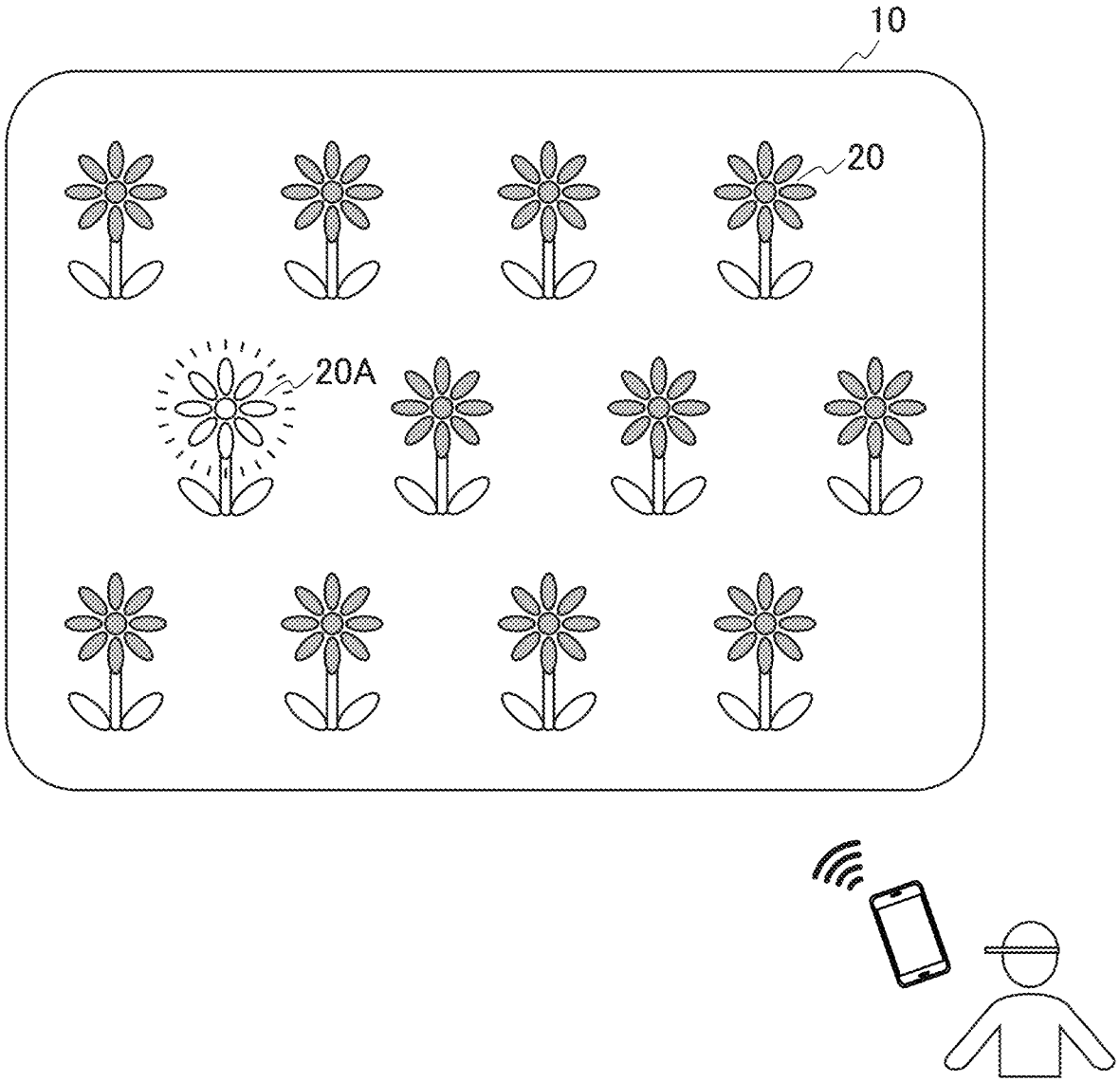
FIG. 2 is a schematic view showing an example of the setting process in the first example embodiment of the present invention.

Next, as shown in FIG. 2, a freely-selected ID signal (e.g., ID: 90) is transmitted to the flower bed 10. Thereby, a light emission tool 20A out of the light emission tools 20 in the flower bed 10 emits light. Then, an image of the flower bed 10 is taken and the position of the light emission tool 20A in the flower bed 10 is associated with the ID signal (ID: 90). By transmitting different ID signals and repeating the above-described process, all the light emission tools 20 in the flower bed 10 can be associated with corresponding ID signals, respectively.

The relationship between the positions of the light emission tools 20 and the ID signals corresponding to the respective light emission tools 20 can be represented by an ID table, for example, as shown in FIG. 3. The ID table can be, for example, made into a database. For example, the light emission tool 20A that emits light in response to the ID signal (ID:90) shown in FIG. 2 is located at the shaded position in FIG. 3.

Figure 4:
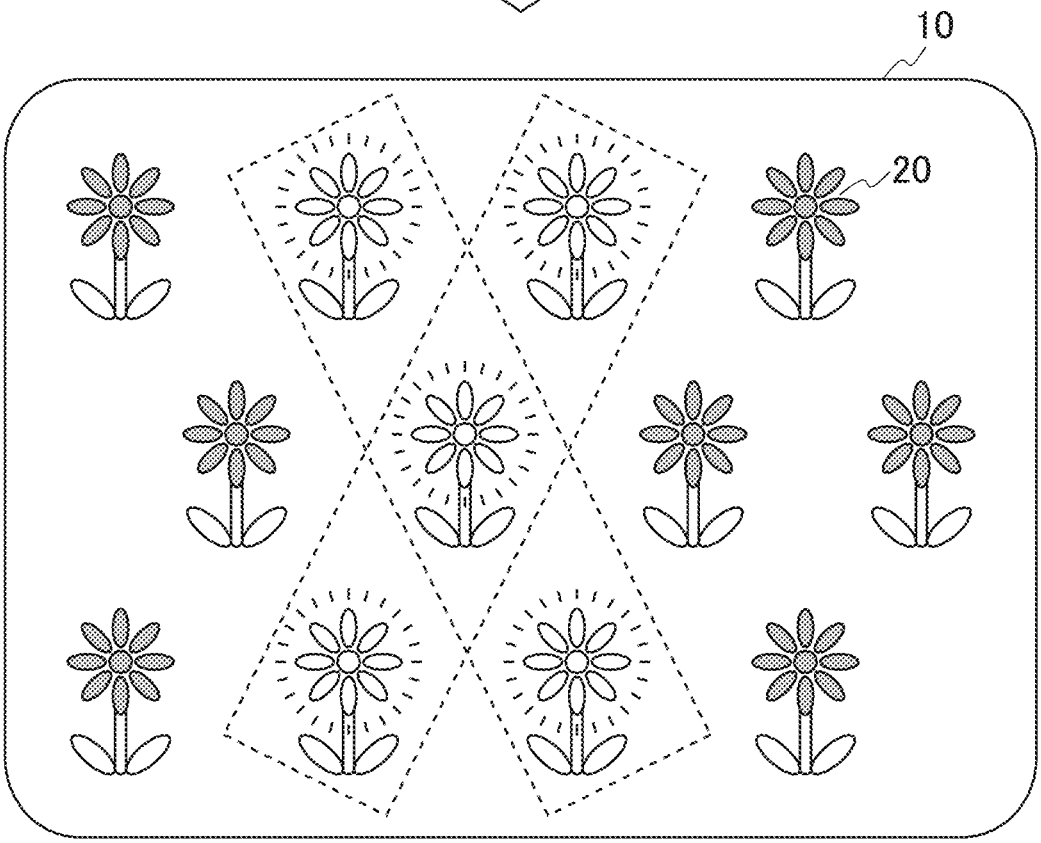
FIG. 4 is a flowchart showing an example of the ID table and the light emission state in an area in the first example embodiment of the present invention.

On the basis of this ID table, for example, in the case of displaying the alphabet "X", "X" can be displayed as shown in FIG. 4 by transmitting the following ID signals: ID: 26, ID: 30, ID: 45, ID 05, and ID: 12.

For example, as to a light emission tool at position 3-1, if the plant individual dies or the wireless LED fails, then a new plant individual is planted at position 3-1 and a wireless LED that emits light in response to a different ID signal is attached thereto. As a result, for example, the light emission control cannot be performed with a table originally created due to replacement of a plant individual or replacement of a wireless LED. However, even if there is such a replacement, the light emission control can be performed by associating the light emission tool and the ID signal again and creating a new table.

While the present invention has been described above with reference to illustrative example embodiments, the present invention is by no means limited thereto. Various changes and variations that may become apparent to those skilled in the art may be made in the configuration and specifics of the present invention without departing from the scope of the present invention.

This application claims priority from Japanese Patent Application No. 2016-173931 filed on Sep. 6, 2016. The entire subject matter of the Japanese Patent Application is incorporated herein by reference.

INDUSTRIAL APPLICABILITY

According to the present invention, it is possible to easily perform the setting of light emission control of each light emission tool in an area.

REFERENCE SIGNS LIST

10 Flower bed
20 Light emission tool

What is claimed is:

1. A method of setting light emission control of each of a plurality of light emission tools in an area, comprising:

transmitting a freely-selected ID signal to the plurality of light emission tools that are randomly disposed in the area and emit light in response to receipt of corresponding ID signals by causing a given light emission tool of the plurality of light emission tools that has received the ID signal to emit the light;

acquiring a light emission image of the area after the ID signal has been transmitted;

determining a position of the given light emission tool ($E_n$) that emitted the light in response to receipt of the ID signal in the area based on the light emission image; and storing the position of the light emission tool in the area and a corresponding ID signal in association with each other, wherein each light emission tool comprises a main body and a receiver, the receiver is attached to the main body, the main body is a plant individual that emits the light by excitation light, and the receiver is a member that emits the excitation light in response to the corresponding ID signal.

2. The method according to claim 1, wherein emitting the light, acquiring the light emission image, determining the position, and storing the position and the corresponding ID signal are repeatedly performed.

3. The method according to claim 1, wherein the receiver is a wireless light source.

4. The method according to claim 3, wherein the wireless light source is a wireless LED.

* * * * *